US011179649B2

(12) United States Patent
Wang

(10) Patent No.: US 11,179,649 B2
(45) Date of Patent: Nov. 23, 2021

(54) UNIVERSAL SPLICING TRACK AND TOY CAR

(71) Applicant: Yuyang Wang, Shantou (CN)

(72) Inventor: Yuyang Wang, Shantou (CN)

( * ) Notice: Subject to any disclaimer, the term of this patent is extended or adjusted under 35 U.S.C. 154(b) by 0 days.

(21) Appl. No.: 17/327,756

(22) Filed: May 23, 2021

(65) Prior Publication Data

US 2021/0283518 A1 Sep. 16, 2021

(30) Foreign Application Priority Data

May 15, 2021 (CN) ..... 202121037083.3

(51) Int. Cl.
*A63H 18/16* (2006.01)
*A63H 18/02* (2006.01)

(52) U.S. Cl.
CPC ..... *A63H 18/16* (2013.01); *A63H 18/02* (2013.01); *A63H 2018/165* (2013.01)

(58) Field of Classification Search
CPC ..... A63H 18/00; A63H 18/02; A63H 18/028; A63H 18/04; A63H 18/08; A63H 18/14; A63H 18/16; A63H 2018/165; A63H 17/264
USPC ..... 446/444, 445, 446, 447, 448, 449, 467; 104/165
See application file for complete search history.

(56) References Cited

U.S. PATENT DOCUMENTS 1,541,589 A * 6/1925 Rossini ..... B61B 13/04 105/29.1
3,540,153 A * 11/1970 Masaru ..... A63H 18/00 446/446
3,603,505 A * 9/1971 Tsugawa ..... A63H 21/04 238/10 E
3,648,407 A * 3/1972 Pressman ..... A63H 18/08 104/120
4,034,678 A * 7/1977 Wilson ..... A63H 21/04 446/446
4,537,577 A * 8/1985 Sansome ..... A63H 18/08 104/120
4,632,038 A * 12/1986 Lawrence ..... A63H 21/04 104/120
D344,992 S * 3/1994 Ruszkai ..... D21/565
5,454,513 A * 10/1995 Wilson ..... A63H 19/30 238/10 E
5,579,997 A * 12/1996 Jackson ..... A63H 18/02 238/10 A
5,794,846 A * 8/1998 Barrett ..... A63H 19/30 104/126

(Continued)

*Primary Examiner* — Joseph B Baldori

(57) ABSTRACT

The utility model discloses a universal splicing track and a toy car, comprising a plurality of I-shaped track bodies which can be assembled end to end and a toy car mounted on the track bodies, wherein a first step surface of a base is overlapped with a second step surface of another base, an upper end of the track body is provided with a bar-shaped block, one end of the bar-shaped block is provided with a spherical body, and the other end is provided with a connecting groove matched with the spherical body; and both sides of the bar-shaped block are provided with racks, a power mechanism is provided with output gears meshing with the racks at the two sides of the bar-shaped block, and one end of the output gear is provided with a guide wheel for clamping the bar-shaped block.

7 Claims, 4 Drawing Sheets

(56) References Cited

U.S. PATENT DOCUMENTS

| | | | | |
|---|---|---|---|---|
| 6,572,434 | B2 * | 6/2003 | Man | A63H 18/16 446/431 |
| 6,631,850 | B1 * | 10/2003 | Wa | A63H 18/021 104/60 |
| 6,648,237 | B2 * | 11/2003 | Rothkopf | A63H 18/02 238/10 B |
| 7,051,948 | B2 * | 5/2006 | Wa | A63H 18/021 238/10 A |
| 7,517,272 | B2 * | 4/2009 | Bedford | A63H 21/04 446/444 |
| 7,770,524 | B1 * | 8/2010 | Wa | A63H 18/16 105/29.2 |
| 7,922,101 | B2 * | 4/2011 | Norman | A63H 21/04 238/10 R |
| 10,195,537 | B2 * | 2/2019 | Yakos | A63H 17/262 |
| 2008/0265049 | A1 | 10/2008 | Stadlbauer | |
| 2012/0171925 | A1 | 7/2012 | Damarin | |
| 2013/0221119 | A1 * | 8/2013 | Jobe | A63H 17/26 238/10 A |
| 2019/0060772 | A1 | 2/2019 | Hamel et al. | |

* cited by examiner

UNIVERSAL SPLICING TRACK AND TOY CAR

BACKGROUND OF THE INVENTION

1. Technical Field

The utility model relates to the technical field of toys, in particular to a universal splicing track and a toy car.

2. Description of Related Art

As we all know, the track toy car is a toy with a toy car moving on tracks. By splicing the tracks, different track configurations can be obtained, thus allowing the toy car to be played in many ways.

However, the tracks of existing track toys are generally round, planar tracks, which are not intriguing enough for kids, and can only be used when placed on a flat surface, and thus the usage scenario is limited and occupied space is large. In addition, the existing track cars fall off the tracks easily during playing, which cause poor using experience.

BRIEF SUMMARY OF THE INVENTION

In view of the shortcomings in the prior art, the utility model aims to provide a universal splicing track and a toy car.

In order to achieve the above purpose, the utility model adopts the following technical solution:

A universal splicing track and a toy car comprise a plurality of I-shaped track bodies which can be assembled end to end and a toy car mounted on the track bodies, wherein a lower end of the track body is provided with a base, and an upper end of the base is provided with a first step surface and a lower end is provided with a second step surface; the first step surface of one base is overlapped with the second step surface of another base, an upper end of the track body is provided with a bar-shaped block, one end of the bar-shaped block is provided with a spherical body, and the other end is provided with a connecting groove matched with the spherical body; and both sides of the bar-shaped block are provided with racks, a power mechanism is arranged on the toy car, the power mechanism is provided with output gears meshing with the racks at the two sides of the bar-shaped block, and one end of the output gear is provided with a guide wheel for clamping the bar-shaped block.

Preferably, a limiting piece is arranged at the spherical body of the bar-shaped block, and a limiting groove matched with the limiting piece is arranged in the connecting groove of the bar-shaped block.

Preferably, a bottom of the toy car is provided with guide pieces at the sides of the bar-shaped block.

Preferably, a lower end of the bar-shaped block is provided with an arc surface, and the guide wheel abuts against the arc surface.

Preferably, the power mechanism comprises a control board, a battery, a motor and an underdriving gear set connected with a rotating shaft of the motor, an output shaft of the underdriving gear set is connected with the output gear, and both the battery and the motor are electrically connected with the control board.

Preferably, the toy car is provided with a switch button electrically connected with the control board.

Preferably, the base is provided with anti-skid bumps, and wheels of the toy car abut against the anti-skid bumps on the base.

By adopting the above solution, the utility model has the following beneficial effects:

1. The toy car rides on the I-shaped track bodies, the upper end of the track body is provided with the bar-shaped block, and both ends of the bar-shaped block are respectively provided with the spherical body and the connecting groove matched with the spherical body; therefore, one track body is installed in the connecting groove of another track body through the spherical body, and the spherical bodies and the connecting grooves are assembled to form a universal hinge; the track bodies can rotate in any direction and angle, can be assembled end to end into a ring, a straight line or a curve and can be extended indefinitely, so as to be adapted to various scenes while saving plane space and offering great fun;

2. The racks are arranged on both sides of the bar-shaped block, and the power mechanism of the toy car is provided with the output gears meshing with the racks at the two sides of the bar-shaped block; one end of the output gear is provided with the guide wheel for clamping the bar-shaped block, and the guide wheel is clamped on the bar-shaped block of the track body, so the toy car can be played in various use scenarios; besides, the toy car rides on the track bodies and can move freely without sliding off, which is fun to play; and the toy car is simple in structure, convenient to operate and high in practicality.

Figure 1:
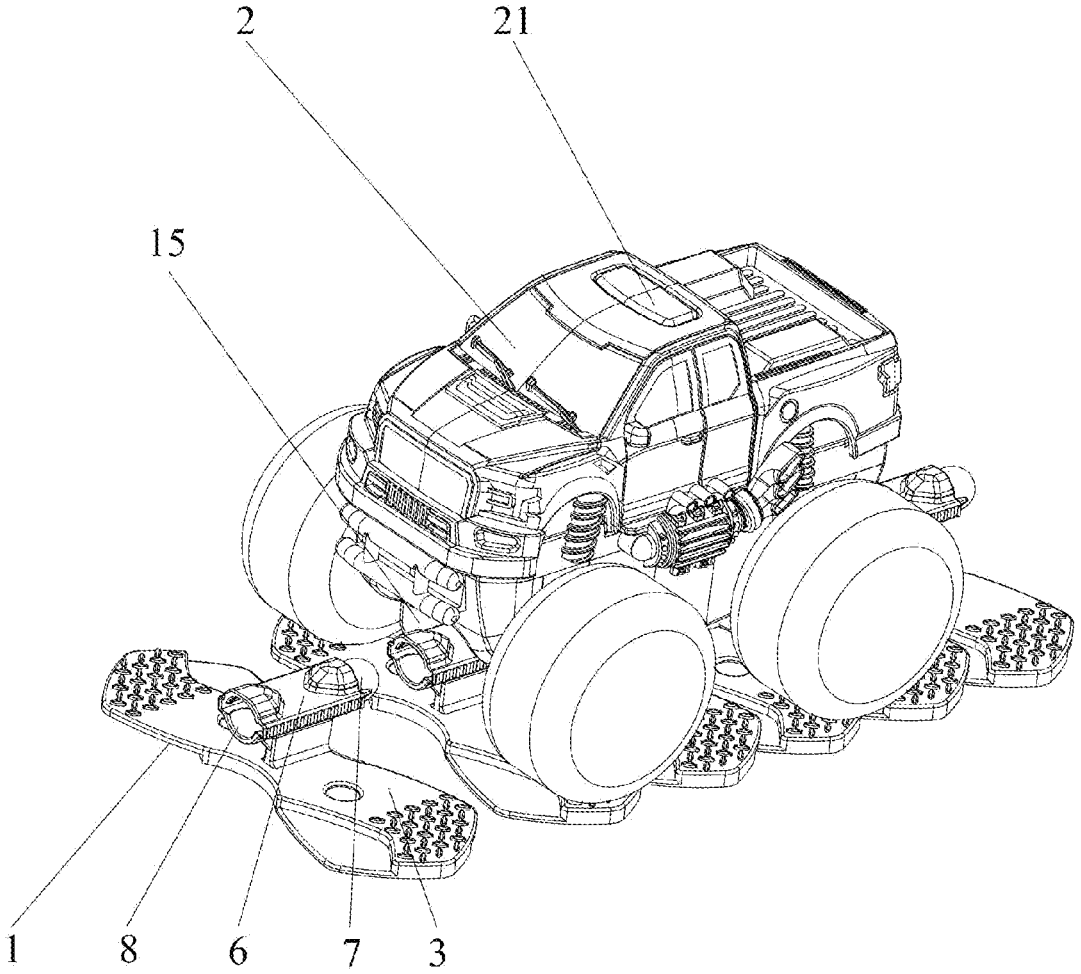
FIG. 1 is an isometric view of an embodiment of the utility model.

track body 1, toy car 2, base 3, first step surface 4, second step surface 5, bar-shaped block 6, spherical body 7, connecting groove 8, rack 9, power mechanism 10, output gear 11, guide wheel 12, limiting piece 13, limiting groove 14, guide piece 15, arc surface 16, control board 17, battery 18, motor 19, underdriving gear set 20, switch button 21, anti-skid bump 22.

DETAILED DESCRIPTION OF THE INVENTION

The embodiments of the utility model will be described in detail with reference to the drawings below, but the utility model can be implemented in many different ways defined and covered by the Claims.

Figure 2:
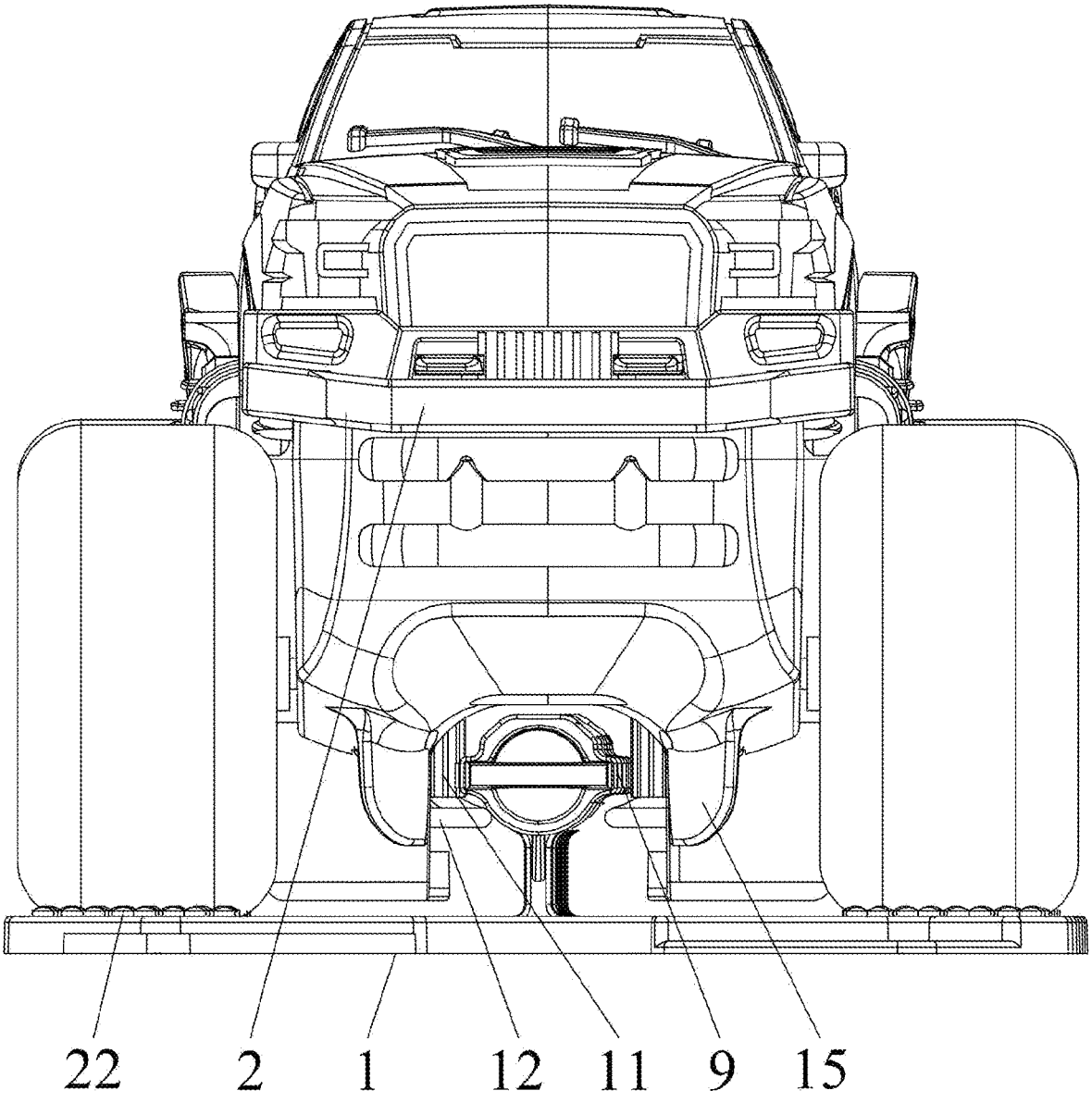
FIG. 2 is a left view of an embodiment of the utility model.
Figure 3:
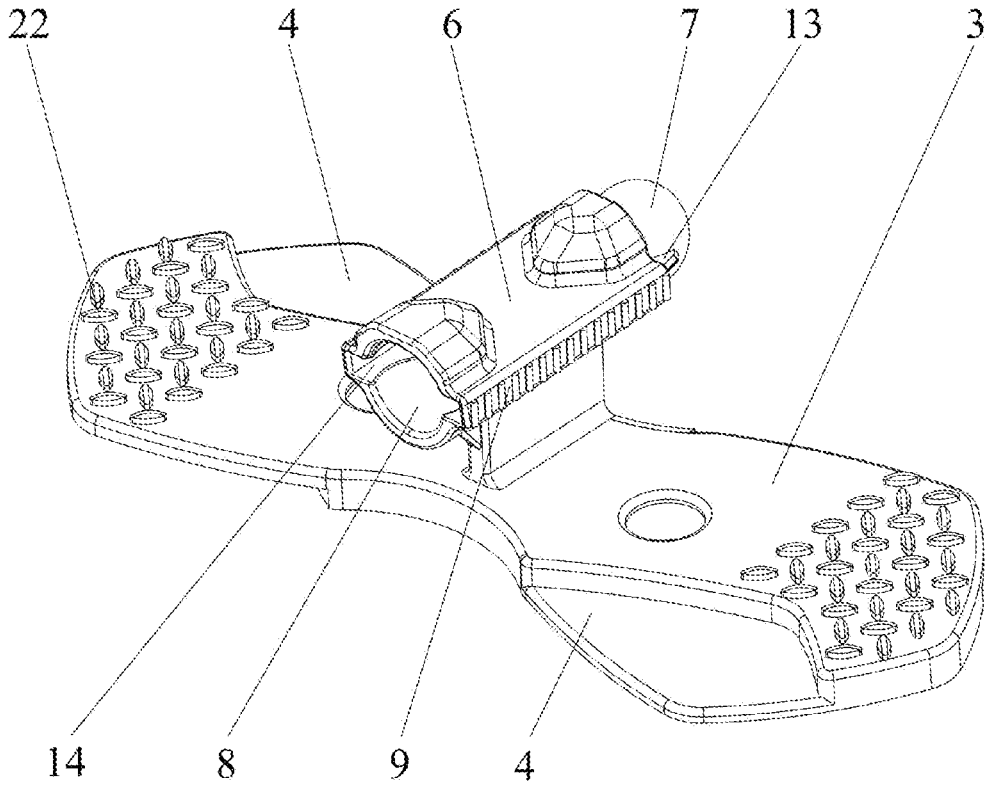
FIG. 3 is a structural diagram of a track body according to an embodiment of the utility model.
Figure 4:
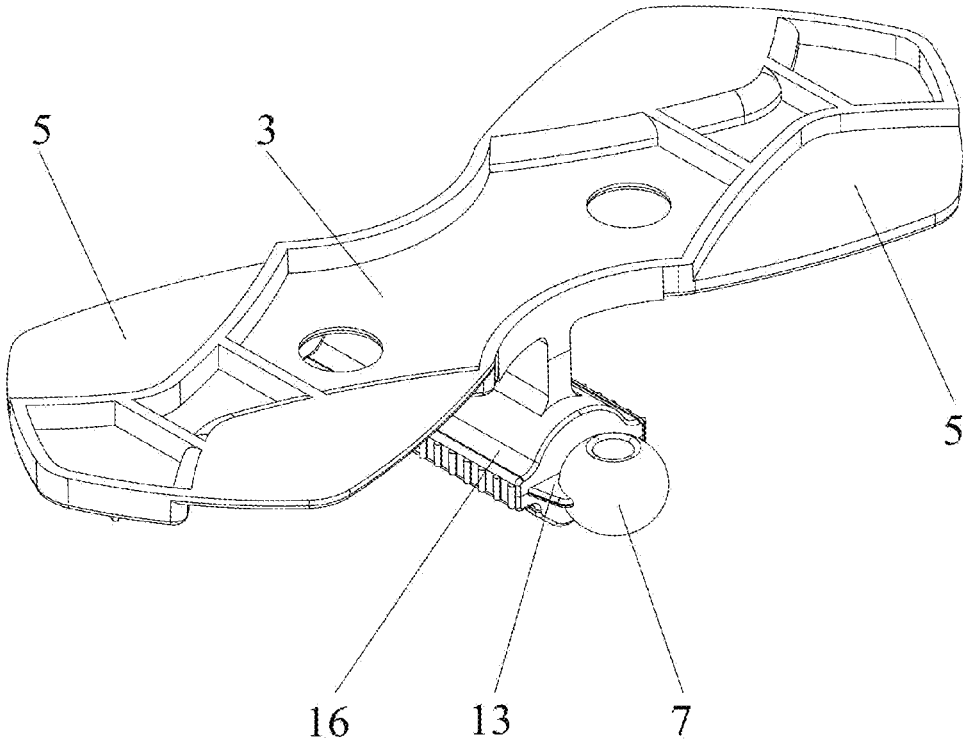
FIG. 4 is a structural diagram of a track body according to an embodiment of the utility model from another perspective.
Figure 5:
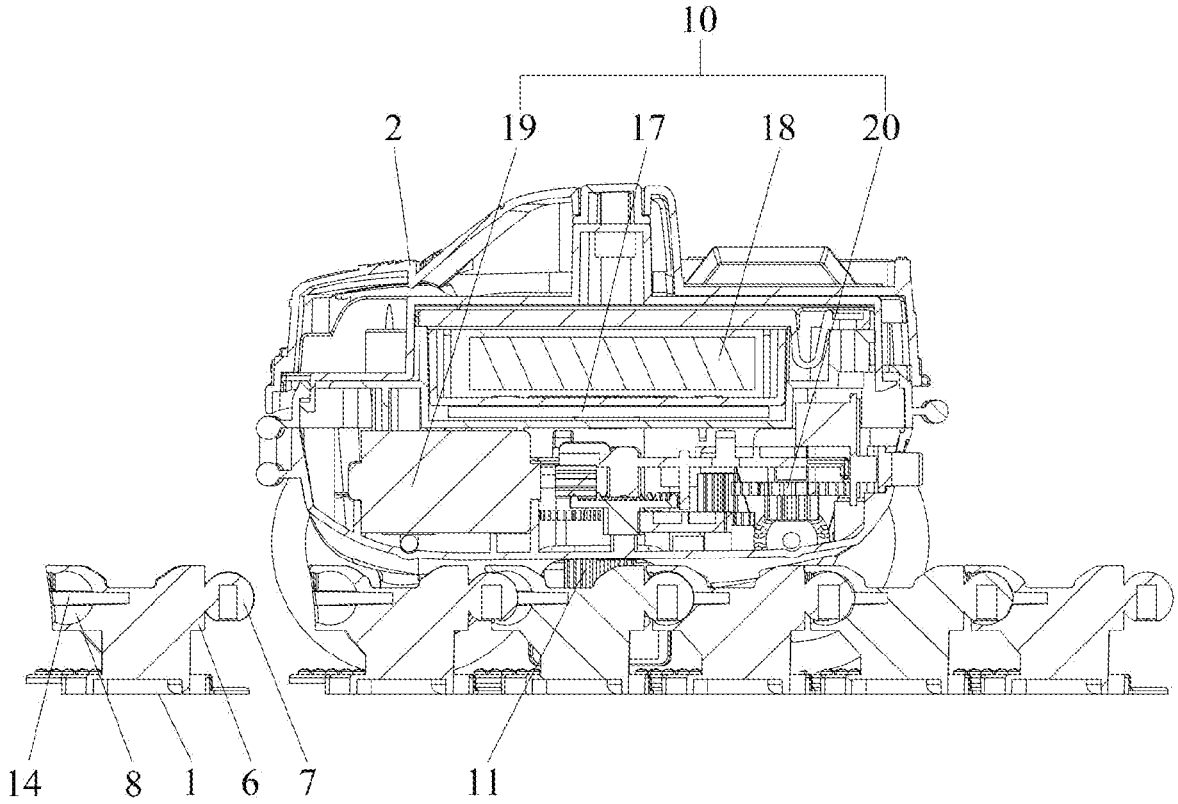
FIG. 5 is a sectional view of an embodiment of the utility model.

As shown in FIGS. 1-5, a universal splicing track and a toy car provided by the embodiment comprise a plurality of I-shaped track bodies 1 which can be assembled end to end and a toy car 2 mounted on the track bodies 1, wherein a lower end of the track body 1 is provided with a base 3, and an upper end of the base 3 is provided with a first step surface 4 and a lower end is provided with a second step surface 5; the first step surface 4 of one base 3 is overlapped with the second step surface 5 of another base 3, an upper end of the track body 1 is provided with a bar-shaped block 6, one end of the bar-shaped block 6 is provided with a spherical body 7, and the other end is provided with a connecting groove 8 matched with the spherical body 7; and both sides of the bar-shaped block 6 are provided with racks 9, a power mechanism 10 is arranged on the toy car 2, the power mechanism 10 is provided with output gears 11 meshing with the racks 9 at the two sides of the bar-shaped block 6, and one end of the output gear 11 is provided with a guide wheel 12 for clamping the bar-shaped block 6.

Further, in this embodiment, a limiting piece 13 is arranged at the spherical body 7 of the bar-shaped block 6, and a limiting groove 14 matched with the limiting piece 13 is arranged in the connecting groove 8 of the bar-shaped block 6.

Further, in this embodiment, a bottom of the toy car 2 is provided with guide pieces 15 at the sides of the bar-shaped block 6.

Further, in this embodiment, a lower end of the bar-shaped block 6 is provided with an arc surface 16, and the guide wheel 12 abuts against the arc surface 16.

Further, in this embodiment, the power mechanism 10 comprises a control board 17, a battery 18, a motor 19 and an underdriving gear set 20 connected with a rotating shaft of the motor 19, an output shaft of the underdriving gear set 20 is connected with the output gear 11, and both the battery 18 and the motor 19 are electrically connected with the control board 17.

Further, in this embodiment, the toy car 2 is provided with a switch button 21 electrically connected with the control board 17.

Further, in this embodiment, the base 3 is provided with anti-skid bumps 22, and wheels of the toy car 2 abut against the anti-skid bumps 22 on the base 3.

In actual use, the toy car 2 rides on the I-shaped track bodies 1, the upper end of the track body 1 is provided with the bar-shaped block 6, and both ends of the bar-shaped block 6 are respectively provided with the spherical body 7 and the connecting groove 8 matched with the spherical body 7; therefore, one track body 1 is installed in the connecting groove 8 of another track body 1 through the spherical body 7, and the spherical bodies 7 and the connecting grooves 8 are assembled to form a universal hinge which can rotate in any direction and angle, so that the multiple track bodies 1 can be assembled end to end into a ring, a straight line or a curve and can be extended indefinitely; besides, the formed tracks can be used on flat surfaces, and can also be used on various uneven surfaces or surfaces with different angles or heights, so a track body chain connected by the universal hinge can be applied to various scenes, thereby greatly improving scenario adaptation, saving plane space because a flat surface is not a necessity any more, and offering more fun.

The racks 9 are arranged on both sides of the bar-shaped block 6, and the power mechanism 10 of the toy car 2 is provided with the output gears 11 meshing with the racks 9 at the two sides of the bar-shaped block; one end of the output gear 11 is provided with the guide wheel 12 for clamping the bar-shaped block 6, and the guide wheel 12 is clamped on the bar-shaped block 6 of the track body 1, so the toy car can be played in various use scenarios; besides, the toy car 2 rides on the track bodies 1 and can move freely without sliding off, which is fun to play.

Further, in this embodiment, the toy car 2 riding on the plurality of track bodies 1 assembled end to end can be played on sofas, rugged roads, walls, cars, tabletops, etc., and the specific use and playing scenes are not specifically limited in this embodiment.

The above are only preferred embodiments of the utility model, which do not limit the patent scope of the utility model. Any equivalent structure or equivalent flow transformation made by using the contents of the specification and drawings of the utility model, or direct or indirect application to other related technical fields, is equally included in the patent protection scope of the utility model.

What is claimed is:

1. A universal splicing track and a toy car, comprising a plurality of 8-shaped track bodies which can be assembled end to end and a toy car mounted on the track bodies, wherein a lower end of each track body of the plurality of track bodies is provided with a base having a left side, a right side, a front side and a rear side, and an upper end of the base is provided with two first step surfaces and a lower end is provided with two second step surfaces; one of the two first step surfaces is provided at the left side and the rear side of the base, the other one of the two first step surfaces is provided at the right side and the front side of the base, one of the two second surfaces is provided at the left side and the front side of the base, the other one of the two second surfaces is provided at the right side and the rear side of the base, the two first step surfaces of one base are overlapped with the two second step surfaces of another base, an upper end of each track body is provided with a bar-shaped block extending from the front side to the rear side, one end of the bar-shaped block is provided with a connecting body having a partially spherical surface, and the other end is provided with a connecting groove matched with the connecting body; and both sides of the bar-shaped block are provided with racks, a power mechanism is arranged on the toy car, the power mechanism is provided with an output gear meshing with the racks at the two sides of the bar-shaped block, planes where the racks are meshed with the output gears are perpendicular to the base, and one end of the output gear is provided with a guide wheel for clamping the bar-shaped block.

2. The universal splicing track and the toy car according to claim 1, characterized in that a limiting piece is arranged at the connecting body of the bar-shaped block, and a limiting groove matched with the limiting piece is arranged in the connecting groove of the bar-shaped block.

3. The universal splicing track and the toy car according to claim 2, characterized in that a bottom of the toy car is provided with guide pieces arranged along the sides of the bar-shaped block.

4. The universal splicing track and the toy car according to claim 3, characterized in that a lower end of the bar-shaped block is provided with an arc surface, and the guide wheel abuts against the arc surface.

5. The universal splicing track and the toy car according to claim 4, characterized in that the power mechanism comprises a control board, a battery, a motor and an underdriving gear set connected with a rotating shaft of the motor, an output shaft of the underdriving gear set is connected with the output gear, and both the battery and the motor are electrically connected with the control board.

6. The universal splicing track and the toy car according to claim 5, characterized in that the toy car is provided with a switch button electrically connected with the control board.

7. The universal splicing track and the toy car according to claim 6, characterized in that the base is provided with anti-skid bumps, and wheels of the toy car abut against the anti-skid bumps on the base.

* * * * *